US008481797B2

(12) United States Patent
Smith et al.

(10) Patent No.: US 8,481,797 B2
(45) Date of Patent: Jul. 9, 2013

(54) PROCESSES FOR MAXIMIZING HIGH-VALUE AROMATICS PRODUCTION UTILIZING STABILIZED CRUDE BENZENE WITHDRAWAL

(75) Inventors: Michael R. Smith, Rolling Meadows, IL (US); Gavin P. Towler, Inverness, IL (US)

(73) Assignee: UOP LLC, Des Plaines, IL (US)

( * ) Notice: Subject to any disclaimer, the term of this patent is extended or adjusted under 35 U.S.C. 154(b) by 307 days.

(21) Appl. No.: 12/896,608

(22) Filed: Oct. 1, 2010

(65) Prior Publication Data

US 2012/0083639 A1 Apr. 5, 2012

(51) Int. Cl.
*C07C 7/04* (2006.01)

(52) U.S. Cl.
USPC ..... 585/802; 585/804; 585/820

(58) Field of Classification Search
None
See application file for complete search history.

(56) References Cited

U.S. PATENT DOCUMENTS

| | | | |
|---|---|---|---|
| 5,053,573 | A | 10/1991 | Jorgensen et al. |
| 5,171,916 | A | 12/1992 | Le et al. |
| 5,414,172 | A | 5/1995 | Chin et al. |
| 6,677,496 | B2 | 1/2004 | Netzer |
| 7,713,386 | B2 | 5/2010 | Schultz et al. |
| 7,910,070 | B2 * | 3/2011 | Zimmerman et al. ..... 422/187 |
| 2008/0161622 | A1 | 7/2008 | Frey et al. |
| 2009/0069613 | A1 | 3/2009 | Rice et al. |
| 2009/0211943 | A1 | 8/2009 | Loescher et al. |
| 2010/0063334 | A1 | 3/2010 | Vichailak et al. |
| 2010/0143213 | A1 | 6/2010 | Zimmerman et al. |
| 2010/0145118 | A1 | 6/2010 | Zimmerman et al. |
| 2010/0160699 | A1 | 6/2010 | Frey et al. |

OTHER PUBLICATIONS

Johnson, J., et al., Unlocking High Value Xylenes from Light Cycle Oil, AM-070-40, UOPLLC, Jan. 2007.

* cited by examiner

*Primary Examiner* — Tam M Nguyen
(74) *Attorney, Agent, or Firm* — Mark R Willis

(57) ABSTRACT

Processes for maximizing high-value aromatics production utilizing stabilized crude benzene withdrawal are provided. Aromatic reactor effluent comprising a $C_5$− fraction and a $C_6$ to $C_{10}$ fraction is separated into a benzene-rich stream and liquid and vapor streams depleted in benzene, one of the liquid streams depleted in benzene being a benzene-depleted $C_6$− fraction. At least a portion of the $C_5$− fraction from the benzene-rich stream is removed.

14 Claims, 3 Drawing Sheets

PROCESSES FOR MAXIMIZING HIGH-VALUE AROMATICS PRODUCTION UTILIZING STABILIZED CRUDE BENZENE WITHDRAWAL

FIELD OF THE INVENTION

The present invention generally relates to aromatics production, and more particularly relates to processes for maximizing high-value aromatics production utilizing stabilized crude benzene withdrawal.

DESCRIPTION OF RELATED ART

Hydrocarbon feedstocks may be converted to aromatic compounds, including the high-value mixed xylenes as well as the byproducts toluene and benzene, as well as to low sulfur diesel and other hydrocarbon products. A high-value mixed xylene stream is that which is suitable feedstock for para-xylene ("p-xylene") production and meets or exceeds ASTM D5211 Standard Specification for Xylenes Suitable for p-Xylene Feedstock and comprising at least 78% total xylenes (mixture of meta-, ortho-, and para-xylene) by weight. Mixed xylenes are "high value" because of their importance as chemical intermediates. One such feedstock is light cycle oil (LCO), a complex combination of hydrocarbons produced by the distillation of products from, for example, the fluidized catalytic cracking (FCC) process. A typical LCO has carbon numbers in the range of $C_9$ to $C_{25}$, and boiling in the approximate range of 171 to 371° C. (340 to 700° F.). LCO is an economical and advantageous feedstock as it is undesirable as a finished product.

Effective utilization of the products and recycle streams in such conversion processes increases their economic feasibility. Unfortunately, benzene buildup in the process system lowers process efficiency and throughput of the high value mixed xylenes. In addition, benzene-containing product and recycle streams require additional processing to reduce their benzene content to acceptable levels, resulting in longer processing paths. Such additional processing has conventionally included the use of additional separation columns and reliance on other process units (including integration with a conventional aromatics complex), thereby increasing operating and capital costs. Furthermore, the LCO to xylenes conversion process in particular may be performed in a standalone unit that operates independently of a conventional aromatics complex, or in a refinery that may not include an aromatics complex. A "standalone" unit is defined as self-contained and does not rely on other units to process its product or recycle streams.

Moreover, the benzene produced is unstabilized crude benzene that cannot be sent safely to an atmospheric storage or transport tank. "Unstabilized crude benzene" contains dissolved light hydrocarbons, such as methane, ethane, propane, and butane, that shift from liquid to gas phase as the pressure is lowered, thereby exerting a high vapor pressure. During storage and transport at atmospheric pressure, the light hydrocarbons vaporize or "flash out" into the space between the liquid and the roof of the storage or transport tank. These vapors are vented to the atmosphere, carrying benzene with them, a known carcinogen. Such benzene emissions are unsafe and may be extensively regulated by governmental authorities. "Stabilized crude benzene" has these volatile light hydrocarbons reduced to levels that substantially prevent this venting process.

Accordingly, it is desirable to provide processes for maximizing high-value aromatics production utilizing stabilized crude benzene withdrawal. It is also desirable to provide processes for maximizing high-value aromatics production by stabilizing the crude benzene and reducing the benzene content in product and recycle streams of such processes, thereby minimizing additional processing thereof, improving process efficiency and throughput of the high-value aromatics, while reducing operating and capital costs. It is additionally desirable to provide processes for maximizing high-value aromatics production in a standalone unit. Furthermore, other desirable features and characteristics of the present invention will become apparent from the subsequent detailed description of the invention and the appended claims, taken in conjunction with the accompanying drawings and this background of the invention.

SUMMARY OF THE INVENTION

Processes are provided for maximizing high-value aromatics production. In accordance with one exemplary embodiment, the process comprises separating aromatic reactor effluent comprising a $C_5$− fraction and a $C_6$ to $C_{10}$ fraction into a benzene-rich stream and liquid and vapor streams depleted in benzene, one of the liquid streams depleted in benzene comprising a benzene-depleted $C_6$− fraction. At least a portion of the $C_5$− fraction is removed from the benzene-rich stream.

Processes are provided for maximizing high-value aromatics production in accordance with yet another exemplary embodiment of the present invention. The process comprises introducing aromatic reactor effluent to a dehexanizer column. A benzene-depleted liquid stream is removed from the dehexanizer column. The benzene-depleted liquid stream comprises $C_5$− paraffins. A benzene-rich stream is removed from the dehexanizer column. The benzene-rich stream comprises unstabilized crude benzene containing $C_1$ to $C_5$ paraffins and benzene. A benzene-depleted vapor stream is removed from the dehexanizer column. The benzene-depleted vapor stream comprises hydrogen gas and $C_1$ to $C_4$ paraffins. A benzene-depleted liquid stream is removed from the dehexanizer column. The benzene-depleted liquid stream comprises $C_{7+}$ aromatics. The benzene-rich stream is introduced into a benzene stripping column to at least partially remove the $C_1$ to $C_5$ paraffins.

Processes are provided for maximizing high-value aromatics production in accordance with yet another exemplary embodiment of the present invention. The process comprises introducing reactor effluent into a dehexanizer column to produce unstabilized crude benzene. The unstabilized crude benzene is introduced into a benzene sidecut stripping column to at least partially remove $C_1$ to $C_5$ paraffins therein.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Various embodiments are directed to a process for maximizing high-value aromatics production utilizing stabilized crude benzene withdrawal using a dehexanizer column and a benzene sidecut splitting column in an aromatics fractionation section. An aromatics reaction section of the process produces a reactor effluent liquid comprised of unstabilized $C_6$-$C_{10}$ material (predominantly aromatics) and $C_5$− material. The feed to the aromatics reaction section is heavy naphtha, high in aromatics, from a hydrocracking reaction section and a hydrocracking fractionation section of a light cycle oil (LCO) to xylenes conversion process, an exemplary aromatics production process. The heavy naphtha undergoes dehydrogenation to convert the paraffins therein to aromatics, followed by toluene disproportionation and transalkylation. The unstabilized $C_6$-$C_{10}$ fraction (containing unstabilized crude benzene, toluene, xylenes, and higher alkyl-substituted aromatics) in the reactor effluent liquid is stabilized as hereinafter described, and then separated into products such as the high-value mixed xylenes and into recycle streams that are reused within the process. The $C_5$− light hydrocarbons ($C_1$-$C_5$ reaction byproducts) are separated and returned to the hydrocracking fractionation section of the process for recovery of refinery products.

Figure 1:
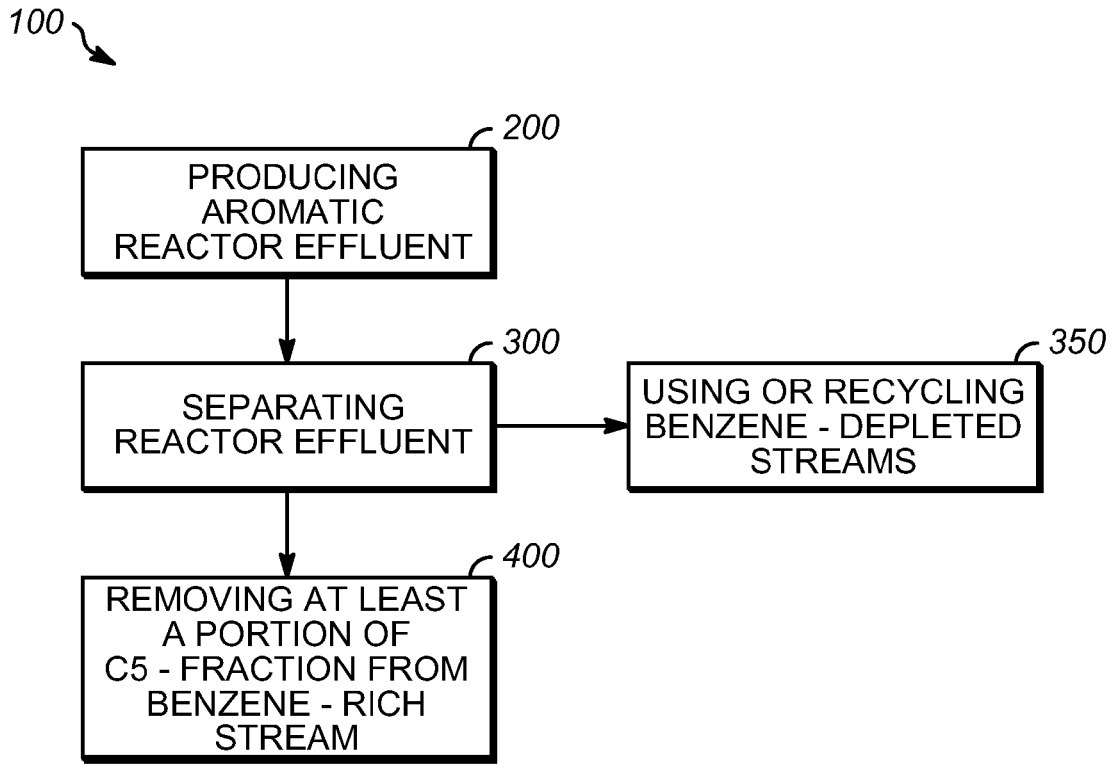
FIG. 1 is a block flow diagram of a process for maximizing high-value aromatics production utilizing stabilized crude benzene withdrawal, according to an exemplary embodiment of the present invention.
Figure 2:
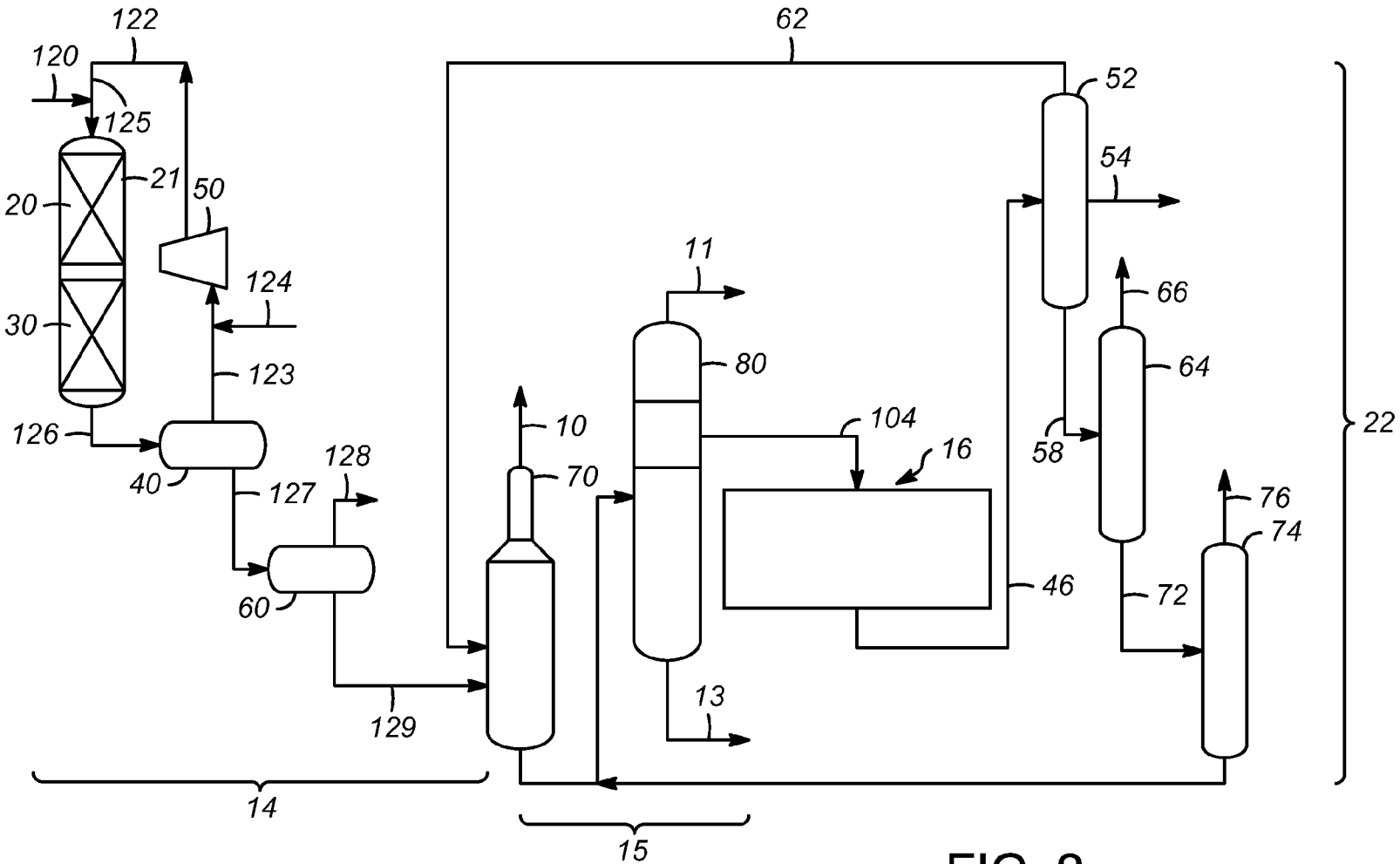
FIG. 2 is a simplified schematic diagram of an exemplary LCO to xylenes conversion process for performing the process of FIG. 1 to produce stabilized crude benzene and reduce the benzene content in product and recycle streams thereof, according to exemplary embodiments of the present invention.
Figure 3:
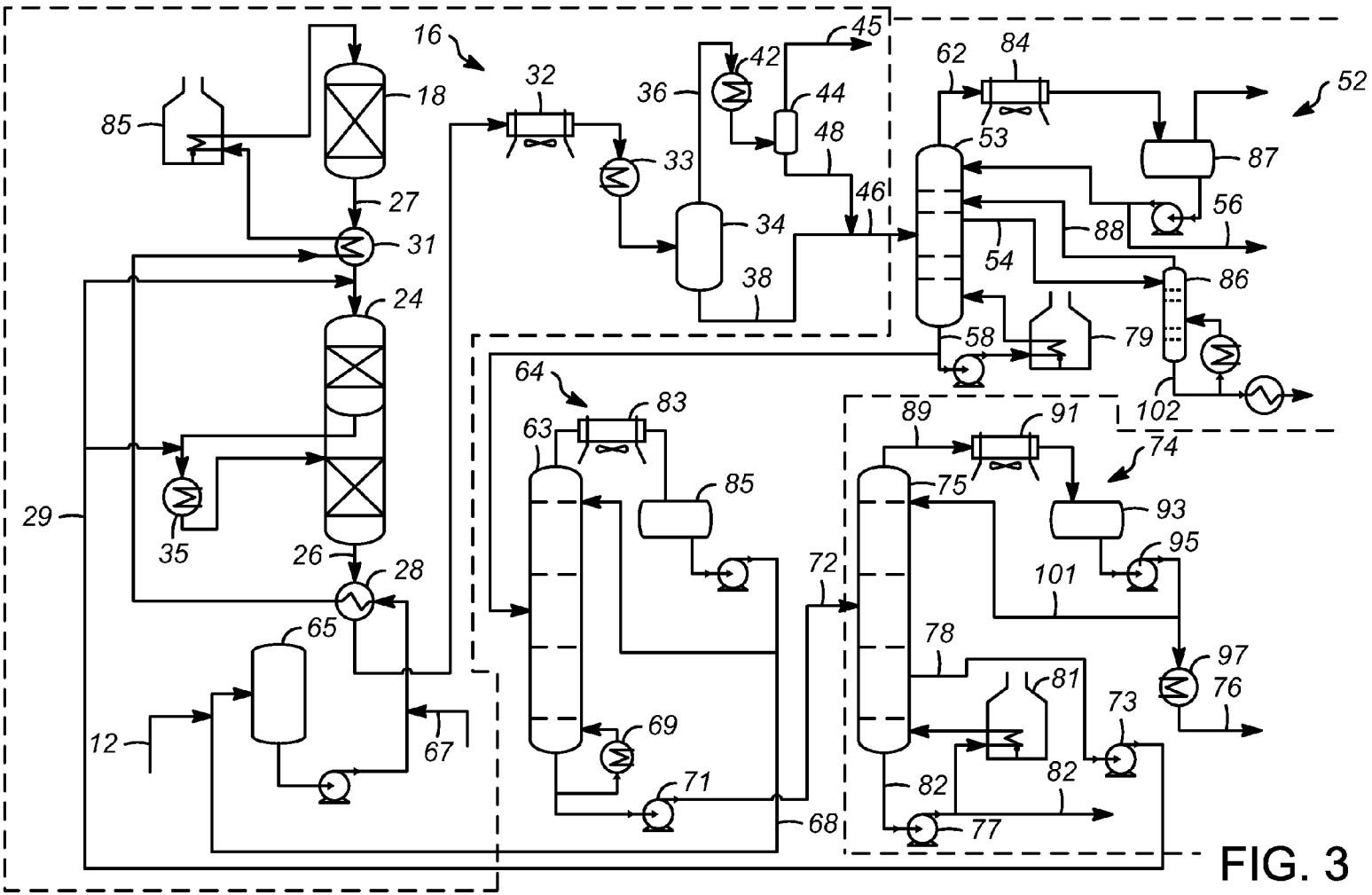
FIG. 3 is a schematic diagram of aromatics reaction and fractionation sections in the exemplary LCO to xylenes conversion process of FIG. 2, according to an exemplary embodiment of the present invention.

As shown in FIGS. 1 and 2, in accordance with an exemplary embodiment, a process 100 for maximizing high-value aromatics production utilizing stabilized crude benzene withdrawal begins by producing reactor effluent from a hydrocarbon feedstock (step 200). Suitable hydrocarbon feedstocks boil in the range from about 149° C. (300° F.) to about 399° C. (750° F.), with carbon numbers typically in the range of $C_9$ to $C_{25}$, and preferably contain at least about 50 vol-% aromatic compounds with the preferred feedstock being one that contains at least a portion of light cycle oil (LCO). LCO is a complex combination of hydrocarbons produced, for example, by the distillation of products from the fluidized catalytic cracking (FCC) process with carbon numbers typically in the range of $C_9$ to $C_{25}$, boiling in the approximate range of 171 to 371° C. (340 to 700° F.). An exemplary simplified process flow diagram illustrating a particular embodiment for carrying out the process is depicted in FIG. 2, with additional detail provided in FIG. 3. FIGS. 2 and 3 are to be understood to present an illustration of the present invention in accordance with exemplary embodiments and/or principles involved. As is readily apparent to one of skill in the art having knowledge of the present disclosure, processes according to various other embodiments of the invention will have configurations, components, and operating parameters determined, in part, by the specific feedstocks, products, and product quality specifications.

According to the embodiment illustrated in FIG. 2, LCO feedstock stream 120 is added to a combined recycle gas stream 122 that is a mixture of a hydrogen-rich gas stream 123 recovered from a high pressure separator 40 and fresh make-up hydrogen stream 124. As shown, both the recovered, hydrogen-rich gas stream 123 and fresh make-up hydrogen stream 124 are fed to the suction or inlet of recycle compressor 50. The combined feed stream 125 is then contacted with hydrotreating catalyst in a hydrotreating zone 20 in a reactor 21 under hydrotreating conditions as known in the art and subsequently with hydrocracking catalyst in a hydrocracking zone 30 of reactor 21 under hydrocracking conditions as known in the art. The hydrotreating and hydrocracking catalysts are known to one skilled in the art. The total effluent stream 126 from hydrocracking zone 30 may be further subjected to hydrotreating using the same or a different hydrotreating catalyst and/or using the same or a different reactor, as used in hydrotreating zone 20, to further reduce sulfur in the ultimately-recovered liquid portion of this total effluent which is the upgraded hydrocarbon product. If no such post-treating is employed, the total effluent stream 126 will comprise, as a liquid portion, the effluent from hydrocracking zone 30 (or hydrocracker effluent), which is then recovered as the upgraded hydrocarbon product. As illustrated in the embodiment shown in FIG. 2, the total effluent stream 126 is sent to high pressure separator 40 to recover the hydrogen-rich gas stream 123. It is to be understood that reactor 21 may be single or plural reactors, and that hydrotreating and/or hydrocracking may occur within a zone within a reactor or in a separate reactor, as known to one skilled in the art.

High pressure separator 40 is generally operated at substantially the same pressure as in hydrocracking zone 30 and at a temperature from about 38° C. (100° F.) to about 71° C. (160° F.). Hydrogen-rich gas stream 123 normally provides the majority of the total hydrogen in combined recycle gas stream 122, with the hydrogen consumed in hydrotreating zone 20 and hydrocracking zone 30 (and lost through dissolution) being replaced by fresh make-up hydrogen stream 124.

Liquid hydrocarbon product 127 from high pressure separator 40 may then be subjected to one or more additional separations, for example in low pressure separator 60 which removes, in off gas stream 128, small amounts of hydrogen dissolved in liquid hydrocarbon product 127 as well as light hydrocarbons (e.g., cracked products) and other light gases such as hydrogen sulfide. The reactor 21, high pressure separator 40, and low pressure separator 60 form a hydrocracking reaction section 14. In the embodiment according to FIG. 2, upgraded hydrocarbon product 129 is recovered as a liquid from low pressure separator 60 and routed to a stripper 70 in a hydrocracking fractionation section 15.

The upgraded hydrocarbon product 129 is fractionated into a liquefied petroleum gas overhead stream 10 and a bottom liquid stream comprising $C_5$+ liquid distillate products in the naphtha, kerosene, and diesel ranges. The bottom liquid stream is sent to a product fractionator 80 for recovery of fuel components. The bottom liquid stream may be blended with a recycle stream from the bottom of a xylene column 75 (FIG. 3) in an aromatics fractionation section 22 (FIGS. 2 and 3). One or several distillation columns may be used to recover naphtha, diesel fuel, and other fuel components, depending on the distillate feedstock processed and desired product slate. According to the embodiment illustrated in FIG. 2, the bottom stream is fractionated into a light naphtha stream 11, a heavy naphtha stream 104, and an ultra-low sulfur diesel (ULSD) fuel stream 13. The light naphtha may be further processed within a standalone LCO to xylenes conversion unit, directed to storage, or to a refinery for further processing. Heavy naphtha 104 is sidecut from the product fractionator 80 and stripped in a heavy naphtha sidecut stripper (not shown) to form stripped heavy naphtha 12 (FIG. 3) to limit the light naphtha component carryover to an aromatics reaction section 16. The heavy naphtha sidecut stripper is reboiled using the ultra-low sulfur diesel fuel stream 13. The hydrocracking fractionation section comprises the stripper 70, the product fractionator 80, and the heavy naphtha sidecut stripper (not shown).

Referring now to FIGS. 2 and 3, the stripped heavy naphtha 12 from the heavy naphtha sidecut stripper, rich in $C_7$ thru $C_{10}$ aromatics, with a boiling range of about 90° C. to about 195° C. (about 194° F. to about 383° F.) passes through sulfur guard beds (for at least partial removal of trace sulfur) (not shown) to the aromatics reaction section 16, shown in detail in FIG. 3. Referring to FIG. 3, the stripped heavy naphtha 12 undergoes dehydrogenation to convert the paraffins therein to aromatics, followed by toluene disproportionation and transalkylation to produce an aromatics-rich high-octane stream containing xylene in the aromatics reaction section 16. The stripped heavy naphtha 12 is mixed with a toluene recycle stream 68 from a toluene column 63 in a toluene column assembly 64 at a feed surge drum 65 before combining with once-thru hydrogen gas 67, being preheated in a heater 85 against transalkylation and dehydrogenation reactor effluents 26 and 27 and charged to a dehydrogenation reactor 18. At least a portion of the paraffins and naphthenes in the heavy naphtha fraction are converted to aromatics in the dehydrogenation reactor. Dehydrogenation conditions applied in the dehydrogenation reactor include a pressure within the range of about 100 kPa (14.7 psig) to about 7 MPa (1000 psig) and a temperature within the range of about 177° C. (about 350° F.) to about 565° C. (1049° F.), using any suitable dehydrogenation catalyst as known to one skilled in the art. Sufficient hydrogen is supplied to the dehydrogenation reactor to thereby provide an amount of about 1 to about 20 moles of hydrogen per mole of hydrocarbon feed entering the dehydrogenation reactor. The liquid hourly space velocity using in dehydrogenating is in the range of about 0.2 to about 20 $hr^{-1}$. The hydrogen-containing effluent 27 from the dehydrogenation reactor passes through quench exchange 31, mixes with a lesser part of a $C_9$ aromatics recycle stream 29 recycled back from an aromatics fractionation section 22 (FIG. 2) as hereinafter described, and is then introduced into a transalkylation reactor 24 under transalkylation conditions to produce transalkylation reactor effluent 26. Transalkylation conditions are known to one skilled in the art. Exemplary transalkylation conditions comprise a temperature of about 200° C. (about 392° F.) to about 540° C. (about 1004° F.), a pressure of about 100 kPa (14.7 psig) to about 6 MPa (870 psig), and a liquid hourly space velocity from about 0.1 to about 20 $hr^{-1}$. While the embodiment illustrated in FIG. 3 shows a two-stage transalkylation reactor 24, with addition of the balance of the $C_9$ aromatics recycled from the aromatics fractionation section and further quenching in another quench exchange 35 between stages to maximize the yield of mixed xylenes, it is possible to use a single or multiple stage transalkylation reactor without additional quenching.

The transalkylation reactor effluent 26 passes through an effluent feed exchanger 28 and is condensed and cooled in a reactor products condenser 32 and reactor products trim condenser 33 before introduction to a product separator 34. The product separator 34 separates the once-thru hydrogen-rich gas 36 from product separator liquid 38. The once-thru hydrogen-rich gas 36 passes through a vent gas chiller 42 and vent gas separator 44 to limit the loss of light products to the off-gas system via the once-thru hydrogen stream. Hydrogen-rich vent gas 45 is removed for further processing. Aromatic reactor effluent 46 comprising the product separator liquid 38 and additional liquid 48 recovered from the vent gas separator passes to a dehexanizer column 53 in the aromatics fractionation section 22 of the system. The aromatics reaction section 16 includes the dehydrogenation and transalkylation reactors 18 and 24.

Returning to FIGS. 1 through 3, process 100 continues by separating the aromatic reactor effluent 46 stream into a benzene-rich stream and benzene-depleted liquid and vapor streams (step 300). Separation is performed in a dehexanizer column 53 in a dehexanizer column assembly 52 within an aromatics fractionation section 22 (FIG. 2), as shown in detail in FIG. 3. The aromatics fractionation section 22 comprises the dehexanizer column assembly 52, the toluene column assembly 64, and a xylene column assembly 74, as hereinafter described. As noted previously, the aromatic reactor effluent stream 46 is an aromatics-rich stream comprising hydrogen gas, a $C_5$− fraction containing $C_1$-$C_5$ paraffins, and an unstabilized $C_6$-$C_{10}$ fraction containing predominantly aromatics (benzene, toluene, xylenes and higher alkyl-substituted aromatics) and some paraffins and naphthenes. The reactor effluent is separated by fractionation in the dehexanizer column. As used herein, the term dehexanizer column may refer to a separate column or a dehexanizer section of a column. The dehexanizer column is reboiled with a dehexanizer reboiler 79. The aromatic reactor effluent 46 is separated into a benzene-depleted overhead liquid stream 56 containing principally unstabilized $C_3$-$C_5$ paraffins and $C_6$ paraffins and aromatics (a "benzene-depleted $C_6$− fraction"), a benzene-depleted liquid bottom stream 58 comprising principally $C_7$+ aromatics (a "benzene-depleted $C_7$+ aromatics fraction"), a benzene-depleted vapor stream 62 comprising hydrogen gas and at least a portion of the $C_5$− fraction, and the benzene-rich stream 54 comprising unstabilized "crude" benzene principally containing $C_1$ to $C_5$ paraffins, and benzene (a $C_6$ aromatic), and hydrogen gas as a sidecut stream. As well known in the art, separation of a multicomponent feed in a column may not result in perfect separation of the desired components. For example, the streams removed from the dehexanizer column comprise the principal components noted previously and may also comprise other components present in the reactor effluent which are introduced to the dehexanizer column. Process conditions are well known to one skilled in the art, unless otherwise noted.

Taking benzene-rich liquid off the dehexanizer column 53 as a side stream keeps benzene levels to a minimum in the other streams and maximizes production of the high-value mixed xylenes. Each of the other streams is removed from the dehexanizer column and may be used as a product stream or further processed and recycled as hereinafter described and known in the art (step 350). For example, referring to FIGS. 2 and 3, the benzene-depleted $C_7$+ hydrocarbon liquid stream 58 may be used as a product stream or recycled within the aromatics reaction and fractionation sections. The benzene-depleted $C_7$+ hydrocarbon liquid fraction comprises toluene and mixed xylenes. The benzene-depleted $C_7$+ hydrocarbon stream 58 passes to the toluene column 63 for recovery and recycle of toluene 66 in the toluene recycle stream 68 acceptable for re-use, such as recycling to mix with the stripped heavy naphtha feed 12 to the dehydrogenation reactor 18 as previously described. In the toluene column assembly 64, the toluene column 63 is reboiled using a toluene column reboiler 69. A vapor stream from the toluene column 63 passes through a toluene column condenser 83 where it condensed and cooled before passing through a toluene column overhead receiver (also known as an "accumulator") 85 to produce the toluene recycle stream 68. A bottom stream 72 from the toluene column, the xylene-and-heavier portion, passes through a pump 71 to a xylene column 75 in the xylene column assembly 74. The xylene column assembly comprises the xylene column 75 and associated equipment, as detailed in FIG. 3

In the xylene column 75, a mixed xylene product stream 76 is recovered as a net xylene overhead liquid from a xylene overhead vapor stream 89 after condensing and cooling in a xylene column condenser 91 and passage through a xylene column overhead receiver 93 and pumped through an exchanger 97. A portion 101 of the cooled and condensed xylene overhead vapor stream 89 may be returned to the xylene column. A liquid side-draw 78, located near the bottom of the xylene column, provides a $C_9$ aromatics-rich stream that is recycled back through a xylene column pump 73 to the aromatics reaction section as previously described, split to feed to the two stages of the transalkylation reactor 24. In a alternative embodiment (not shown), the side-draw 78 may be vapor-phase and directed through a side-draw condenser and a $C_9$ recycle receiver, providing a $C_9$ aromatics-rich stream that is recycled back through the xylene column pump 73 to the aromatics reaction section.

A small "heavies" drag stream 82 from the bottom of the xylene column 75 passes through a pump 77 to the product fractionator 80 (FIG. 2). The "heavies" drag stream serves to limit recycle of "heavies" back to the transalkylation reactor, where they may contribute to overall catalyst coking. As used herein, the term "heavies" refers to $C_9$+ aromatics. The xylene column is reboiled by a xylene column reboiler 81.

Exemplary process conditions for the aromatics reaction and fractionation sections are shown in the table below:

| Exemplary Aromatics Reaction and Fractionation Section Process Conditions | Range (Approximate) |
|---|---|
| Aromatics Product Separator (34): | |
| Pressure, MPa | 0.1-5.9 |
| Temperature, ° C. | 4-121 |
| Dehexanizer (with Crude Benzene Sidecut): | |
| No. of Theoretical Stages in Dehexanizer | |
| Receiver (87): | |
| Pressure, MPa | 0.17-1.37 |
| R/F, molal | 0.3-2.5 |
| No. of Theoretical Stages in Benzene Sidecut Stripper | 2-15 |
| $C_4$- in Sidecut Stabilized Crude Benzene, mol % | 0-5.0 |
| Toluene Column: | |
| No. of Theoretical Stages | 15-135 |
| Receiver (85): | |
| Pressure, MPa | 0-1.0 |
| R/F, molal | 0.2-5 |
| Total Xylenes in Overhead Liquid, mol % | 0.1-10 |
| Toluene in Bottoms (Xylene Fraction), mol ppm | 50-50000 |
| Xylene Column: | |
| No. of Theoretical Stages | 15-135 |
| Receiver (93): | |
| Pressure, MPa | 0-1.0 |
| R/F, molal | 0.5-5 |
| $C_9$ Aromatics in Overhead Liquid, wt ppm | 50-10000 |

wherein: R/F, molal=ratio of moles per unit time of refluxed liquid (R) from the overhead receiver back to the column divided by the moles per unit time of feed (F) to the column.

Referring to FIG. 2, the benzene-depleted overhead liquid stream 56 containing principally unstabilized $C_3$-$C_5$ paraffins and $C_6$ paraffins and aromatics may be recycled to the stripper 70 for recovery of liquefied petroleum gas and stabilized light naphtha so as to yield a low benzene content gasoline blending stream as known in the art. This "short" processing path would not be possible if the overhead stream contained higher levels of benzene.

The benzene-depleted vapor stream 62 may be condensed and cooled in a benzene-depleted vapor stream condenser 84 (FIG. 3) and passed through a condenser overhead receiver 87 before recycling through a sponge absorber system (not shown) in the hydrocracking fractionation section 15 to recover substantially benzene-free fuel gas.

Referring to FIGS. 1 and 3, process 100 continues by removing at least a portion of the $C_5$– fraction (including substantially all of the high vapor pressure, light hydrocarbon fraction ($C_1$-$C_4$) from the benzene-rich stream 54, producing stabilized crude benzene (step 400). The unstabilized crude benzene stream from the dehexanizer column is introduced into the benzene sidecut stripping column 86 to strip the lighter boiling, $C_4$– components from the unstabilized crude benzene. Overhead vapors 88 from the benzene sidecut stripping column principally contain hydrogen gas, $C_1$-$C_5$ paraffins plus a portion of the benzene and its co-boilers (i.e., compounds that distill in the same range as benzene), which are returned to the dehexanizer column. A bottom stream 102 from the benzene sidecut stripping column contains stabilized crude benzene liquid containing principally benzene and its co-boilers. The stabilized crude benzene is higher purity than unstabilized crude benzene because of the removal of the light hydrocarbons, but is less pure than commercially traded chemical- or nitration-grade benzenes (which have greater than 99% benzene purities). The stabilized crude benzene liquid product can be sold as a lower purity benzene product, without the need for additional fractionation that cannot be justified for the relatively small crude benzene stream. If a sufficient amount of the light hydrocarbons is removed from the unstabilized crude benzene stream, the vapor pressure becomes satisfactory for storage and shipment at approximately atmospheric pressure. Such stabilization allows the stabilized crude benzene to be safely stored and transported under atmospheric conditions by reducing its vapor pressure.

As illustrated in FIG. 3, the benzene sidecut stripping column 86 may be separate from the dehexanizer column 53 (hereinafter referred to as an external benzene sidecut stripping column). In another embodiment, the benzene sidecut stripping column may be located within the dehexanizer column (hereinafter referred to as a "combined dehexanizer column with 'internal benzene sidecut stripping column'") using a split-shell, dividing wall, or similar design as known in the art, thereby reducing the plot size, and equipment and piping needs with little or no penalty on the size requirements for the dehexanizer column. The combined dehexanizer column with the internal benzene sidecut stripping column also provides for a reduction in the total amount of fugitive hydrocarbon (specifically, benzene) emissions from flanged connections on associated equipment through a reduction in the total number and size of flanges. With the benzene sidecut stripping column inside the dehexanizer column, the benzene-rich stream is not physically removed from the dehexanizer column in physical piping, but is instead directed by column internals such as trays and/or baffles between dehexanizing and stripping sections of the combined dehexanizer column with internal benzene sidecut stripping column.

It is to be understood that the light cycle oil to xylenes process described above is an exemplary aromatics production process, and that other aromatic production processes that convert highly aromatic $C_7$-$C_{10}$ heavy naphtha boiling about 90° C. to about 195° C. (about 194° F. to about 383° F.)

to aromatics using dehydrogenation, toluene disproportionation, and transalkylation may benefit using the exemplary embodiments according to the present invention. In addition, while such process is particularly beneficial for a standalone light cycle oil to xylenes conversion unit that does not rely upon other units to further process its product and recycle streams, it is to be understood that the light cycle oil to xylenes conversion unit may be integrated with a conventional aromatics complex. It is also to be understood that the process may also be used in a refinery production process to produce diesel fuel and other hydrocarbon products to stabilize crude benzene (if produced) and reduce benzene content in product and recycle streams. The process permits the conversion of a relatively low-value LCO stream into valuable xylene hydrocarbon compounds, low sulfur diesel products, gasoline products, and/or other hydrocarbon products with reduced benzene content.

Accordingly, processes for maximizing high-value aromatics production utilizing stabilized crude benzene withdrawal have been provided. From the foregoing, it is to be appreciated that the exemplary embodiments of the process for maximizing high-value aromatics production utilizing stabilized crude benzene withdrawal includes producing stabilized crude benzene and reducing the benzene content in product and recycle streams. The withdrawn stabilized crude benzene is safe for storage and transport under atmospheric conditions, and the benzene-depleted product and recycle streams are minimally processed, with shorter processing paths, thereby increasing process efficiency and maximizing throughput of the high-value mixed xylenes while reducing operating and capital costs.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for maximizing high-value aromatics production comprising light cycle oil to xylenes conversion utilizing stabilized crude benzene withdrawal, the process comprising the steps of:

separating aromatic reactor effluent comprising a $C_{5-}$ fraction and a $C_6$ to $C_{10}$ fraction into a benzene-rich stream and at least one liquid stream and at least one vapor stream depleted in benzene, one of the liquid streams depleted in benzene comprising a benzene-depleted $C_{6-}$ fraction;

removing at least a portion of the $C_{5-}$ fraction from the benzene-rich stream wherein separation of the benzene rich stream maximizes production of the high-value mixed xylenes; and recycling the benzene-depleted vapor stream through a sponge absorber system in a hydrocracking fractionation system of the aromatics production process to recover substantially benzene-free fuel gas.

2. The process of claim 1, wherein the step of separating comprises separating in a dehexanizer column.

3. The process of claim 2, wherein the step of separating comprises removing an overhead liquid stream from the dehexanizer column, the overhead liquid stream comprising the benzene-depleted $C_{6-}$ fraction.

4. The process of claim 3, wherein the step of separating comprises removing a liquid bottom stream from the dehexanizer column, the liquid bottom stream comprising a benzene-depleted $C_{7+}$ aromatics fraction.

5. The process of claim 3, wherein the step of separating comprises removing the vapor stream from the dehexanizer column, the vapor stream comprising a benzene-depleted vapor stream comprising at least a portion of the $C_{5-}$ fraction.

6. The process of claim 1, wherein the step of removing comprises removing in a benzene sidecut stripping column.

7. The process of claim 1, wherein the step of removing comprises removing in an internal benzene sidecut stripping column, an external benzene sidecut stripping column, or both.

8. The process of claim 3, further comprising the step of recycling the benzene-depleted $C_{6-}$ fraction to a hydrocracking fractionation section for recovery of $C_3/C_4$ liquefied petroleum gas (LPG) and stabilized light naphtha.

9. The process of claim 4, further comprising the step of recycling at least a portion of the benzene-depleted $C_{7+}$ aromatics fraction to aromatics and fractionation sections.

10. A process for maximizing high-value aromatics production comprising light cycle oil to xylenes conversion utilizing stabilized crude benzene withdrawal, the process comprising the steps of:

introducing aromatic reactor effluent to a dehexanizer column; removing a benzene-depleted liquid stream from the dehexanizer column, the benzene-depleted liquid stream comprising $C_3$-$C_5$ paraffins and $C_6$ paraffins and aromatics;

removing a benzene-rich stream from the dehexanizer column, the benzene-rich stream comprising unstabilized crude benzene comprising $C_1$ to $C_5$ paraffins and benzene;

removing a benzene-depleted vapor stream from the dehexanizer column, the benzene-depleted vapor stream comprising hydrogen gas and $C_1$ to C4 paraffins;

removing a benzene-depleted liquid stream from the dehexanizer column, the benzene-depleted liquid stream comprising $C_{7+}$ aromatics;

introducing the benzene-rich stream into a benzene stripping column to at least partially remove the $C_1$ to $C_5$ paraffins therefrom wherein at least a portion of the benzene-depleted liquid stream comprising $C_{7+}$ aromatics is recycled to aromatics reaction and fractionation sections; and recycling the benzene-depleted vapor stream through a sponge absorber system in a hydrocracking fractionation section to recover substantially benzene-free fuel gas.

11. The process of claim 10, wherein the step of introducing comprises introducing into an internal benzene sidecut stripping column, an external benzene sidecut stripping column, or both.

12. The process of claim 10, further comprising the step of recycling the benzene-depleted liquid stream comprising $C_3$-$C_5$ paraffins and $C_6$ paraffins and aromatics to a hydrocracking fractionation section of an aromatics production process for recovery of $C_3/C_4$ liquefied petroleum gas (LPG) and stabilized light naphtha.

13. A process for maximizing high-value aromatics production utilizing stabilized crude benzene withdrawal, comprising the steps of:

introducing aromatic reactor effluent into a dehexanizer column to produce unstabilized crude benzene and a benzene-depleted overhead liquid stream comprising unstabilized $C_3$-$C_5$ paraffins and $C_6$ paraffins and aromatics;

introducing the unstabilized crude benzene into a benzene sidecut stripping column to at least partially remove $C_1$-$C_5$ paraffins therein wherein the benzene depleted overhead liquid stream is recycled to a hydrocracking fractionation section of an aromatics production process for recovery of $C_3$/$C_4$ liquefied petroleum gas (LPG) and stabilized light naphtha.

14. The process of claim 13, wherein the step of introducing the unstabilized crude benzene comprises introducing into an internal benzene sidecut stripping column, an external benzene sidecut stripping column, or both.

* * * * *